US006655933B2

(12) United States Patent
Chiba

(10) Patent No.: US 6,655,933 B2
(45) Date of Patent: Dec. 2, 2003

(54) CAM OPERATED FUEL PUMP WITH SPLIT FUNCTION FOLLOWER SPRINGS

(75) Inventor: Noriaki Chiba, Iwate (JP)

(73) Assignee: Mikuni Corporation, Tokyo (JP)

( * ) Notice: Subject to any disclaimer, the term of this patent is extended or adjusted under 35 U.S.C. 154(b) by 0 days.

(21) Appl. No.: 10/017,322

(22) Filed: Dec. 18, 2001

(65) Prior Publication Data

US 2002/0085936 A1 Jul. 4, 2002

(30) Foreign Application Priority Data

Dec. 28, 2000 (JP) ..... 2000-401707

(51) Int. Cl.[7] ..... F04B 19/00
(52) U.S. Cl. ..... 417/471; 417/470
(58) Field of Search ..... 417/470, 471; 92/129

(56) References Cited

U.S. PATENT DOCUMENTS 1,922,121 A * 8/1933 Brown ..... 137/115.13
1,937,150 A * 11/1933 Hueber et al. ..... 417/364
2,018,111 A * 10/1935 Babitch ..... 417/470
3,095,824 A * 7/1963 Elfes ..... 92/94
3,301,195 A * 1/1967 Streeter ..... 417/471
3,667,740 A * 6/1972 Mortstedt ..... 261/39.2
6,171,081 B1 1/2001 Nakajima et al.

FOREIGN PATENT DOCUMENTS

JP 11-230047 8/1999
JP 2000-282994 10/2000

* cited by examiner

*Primary Examiner*—Cheryl J. Tyler
*Assistant Examiner*—Timothy P. Solak
(74) *Attorney, Agent, or Firm*—Wenderoth, Lind & Ponack, L.L.P.

(57) ABSTRACT

In order to provide a fuel pump in which a piston spring arrangement can be made of inexpensive material, knocking noises of a piston are reduced, and components related to the piston are protected against breakdown, a piston-following spring is provided between a fuel pump body and the piston to lower the piston in response to the rotation of an eccentric cam. A pumping member-moving spring is provided between the fuel pump body and a pin connected to a pumping member, and lowers the pumping member when the piston is moved down. The downward movements of the piston and the pumping member are caused by the springs, so that these springs can be made of inexpensive materials, and enable the piston to reliably follow the eccentric cam.

23 Claims, 7 Drawing Sheets

FIG. 6 - PRIOR ART
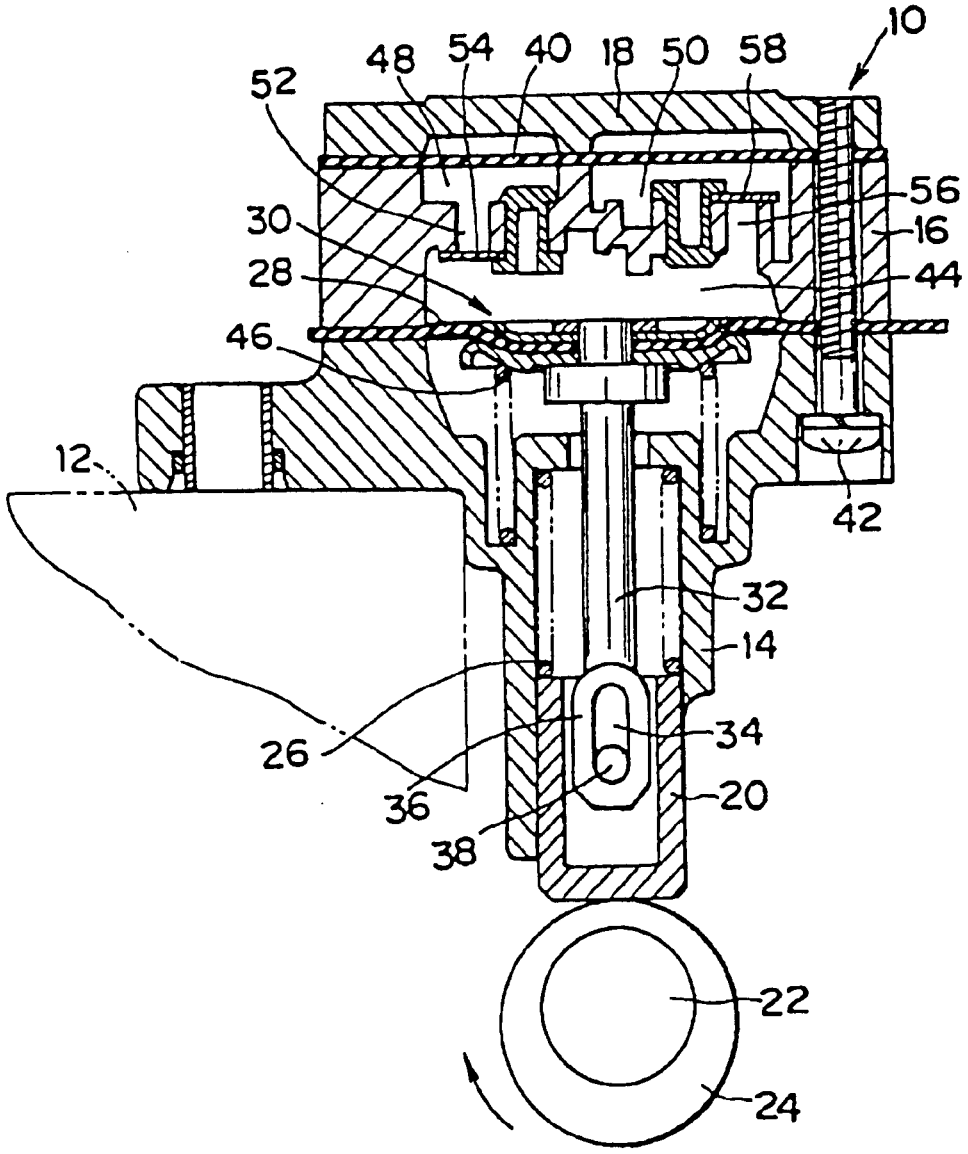

FIG. 7 - PRIOR ART
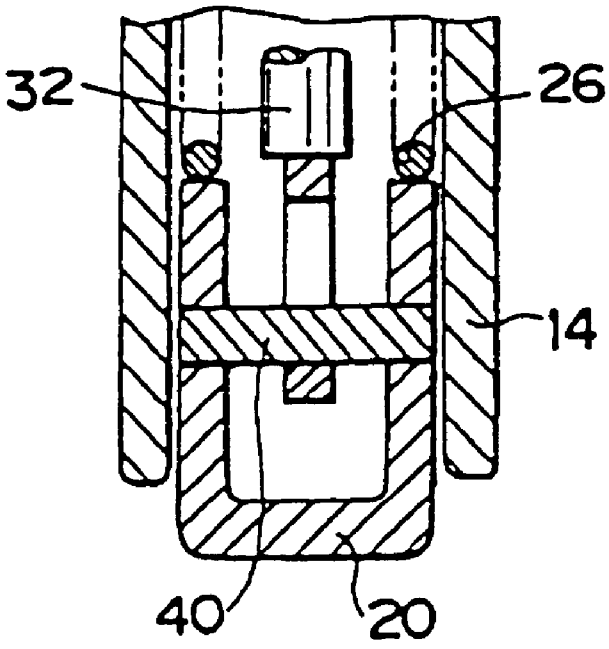

CAM OPERATED FUEL PUMP WITH SPLIT FUNCTION FOLLOWER SPRINGS

BACKGROUND OF THE INVENTION

1. Field of the Invention

The present invention relates to a fuel pump to be actuated by engine power.

2. Description of Related Art

Japanese Laid-Open Publication No. 2000-282994 discloses a prior art fuel pump which utilizes rotation of an eccentric cam by an engine by converting the rotation of the eccentric cam into reciprocating motion of a piston. FIG. 6 of the accompanying drawings shows such a fuel pump 10, and FIG. 7 shows a detailed cross section of essential parts of the fuel pump shown in FIG. 6. The fuel pump 10 includes a bottom body part 14 which is fixedly attached to a cylinder head cover 12 of an engine, a top body part 16 mounted on the bottom body part 14, a cover 18 on the top body part 16, and a piston 20 reciprocally mounted in the bottom body part 14. As shown in FIG. 6, the cover 18 is positioned on top of the top body part 16, and the bottom body part 14 is mounted under the top body part 16.

The fuel pump 10 is to be arranged with a rotary shaft 22 positioned below the piston 20 and having an eccentric cam 24. The shaft 22 is rotated by engine power, and the eccentric cam 24 is positioned at a tip of the piston 20. A piston spring 26 is provided between the piston 20 and the bottom body part 14, and urges the piston 20 toward the eccentric cam 24 so the piston remains in contact with the eccentric cam 24. The piston 20 thus vertically reciprocates in the bottom body part 14 in response to the rotation of the eccentric cam 24.

A diaphragm assembly 30 is coupled to the piston 20, and includes a diaphragm 28 and a rod 32 coupled to the diaphragm 28. An engagement member 36 has an elongated hole 34 along an axis thereof, and is fixedly attached to a tip of the rod 32. Further, a pin 38 is fixedly attached to the piston 20, and fits in the elongated hole 34 of the engagement member 36.

The diaphragm 28 is sandwiched between the bottom body part 14 and the top body part 16, and a seal such as a gasket is sandwiched between the top body part 16 and the cover 18. In this state, the bottom body part 14, the top body part 16 and the cover 18 are fixed together using a bolt 42. A pump chamber 44 is defined by the top body part 16 and the diaphragm 28, and is present near the top body part 16. A diaphragm spring 46 is provided between the bottom body part 14 and the diaphragm 28 in order to continuously urge the diaphragm 28 toward the pump chamber 44 (i.e. toward a pump chamber pressurizing position).

An intake chamber 48 and a discharge chamber 50 are independently defined by the top body part 16 and the seal 40. An intake path 52 is formed in the top body part 16 in order to connect the intake chamber 48 to the pump chamber 44, and the intake path is opened and closed by an intake (one-way) valve 54. Further, the top body part 16 has a discharge path 56 formed therein in order to connect the discharge chamber 48 to the pump chamber 44. The discharge path 56 is opened and closed by a discharge (one-way) valve 58.

In the fuel pump 10, the piston 20 vertically reciprocates in response to the rotation of the eccentric cam 24 fixedly attached around the shaft 22. When both the piston 20 and the diaphragm 28 are moved downward as shown in FIG. 6, the discharge. valve 58 closes the discharge path 56. At the same time, the intake valve 54 is opened, so that fuel is introduced into the pump chamber 44 from the intake chamber 48 via the intake path 52. Thereafter, when the piston 20 and the diaphragm 28 move upward, the intake valve 54 closes the intake path 52, and the discharge valve 58 opens the discharge path 56, so that the fuel is introduced into the discharge chamber 50 from the pump chamber 44.

The piston spring 26 must be sufficiently strong so as to maintain the piston 20 continuously in contact with the eccentric cam 24 so that the piston 20 reliably follows the rotating eccentric cam 24. The piston spring 26 is required for the downward movement of the diaphragm 28 toward a depressurizing position to effect a fuel intake action, and thus must have sufficient strength to overcome the resilient biasing force of the diaphragm spring 46 which resists the downward movement of the diaphragm 28. Further, the larger the diaphragm 28, the stronger must be the resiliency of the piston spring 26. Still further, the more resilient the piston spring 26 must be, the more expensive of a material is generally required to form the piston spring, which inevitably makes the piston spring more expensive.

If the piston spring 26 is weakened, the piston 20 will sometimes fail to follow the eccentric cam 24. In such a case, undesirable noises may be caused due to improper interaction between the piston 20 and the eccentric cam 24. When the piston spring 26 is strengthened in order to overcome this problem, the pin 38 fixedly attached to the piston 20 may strike against the engagement member 36 fixedly attached to the rod 32, thereby causing significant shocks and perhaps large knocking noises. Such striking contact will cause damage to the pin 38 at the contact point, as well as to the diaphragm 28 and components adjacent the rod 32.

SUMMARY OF THE INVENTION

In order to overcome the foregoing problems of the related art, the present invention is intended to provide a fuel pump which does not require expensive material for a piston spring, reduces knocking noises and protects components near colliding portions against damage.

According to the invention, there is provided a fuel pump for pumping fuel in response to rotation of an eccentric cam, the fuel pump comprising: a fuel pump body having a pump chamber; a pumping member-movably provided at the pump chamber for pressurizing and depressurizing the pump chamber, the pumping member being movable between a first pumping member position and a second pumping member position; a piston movably mounted to the fuel pump body and being arranged to be operably engaged with the eccentric cam for movement between first and second ends of a piston stroke, the piston being operably coupled to the pumping member so that the pumping member is caused to move toward the first pumping member position due to the piston moving toward the first end of the piston stroke, and toward the second pumping member position due to the piston moving toward the second end of the piston stroke; a piston-following spring operably engaged with the piston to urge the piston toward the first end of the piston stroke; and a pumping member-moving spring operably engaged with the pumping member to urge the pumping member toward the first pumping member position.

The fuel pump further includes a pumping member spring mechanism urging the pumping member toward the second pumping member position, and the pumping member preferably comprises a diaphragm.

The fuel pump body comprises a first fuel pump body part, and a second fuel pump body part secured to the first fuel pump body part; and the diaphragm is sandwiched between the first and second fuel pump body parts.

The fuel pump further preferably includes a first engagement member coupled to the diaphragm; a second engagement member provided at the piston and being arranged for engagement with the first engagement member; and a plate member positioned between the first engagement member and the pump member-moving spring so as to be urged by the pump member-moving spring toward the first engagement member. The second engagement member is engageable with the first engagement member to limit an amount of movement of the first engagement member relative to the piston. Further, a rod preferably couples the first engagement member to the pumping member; the first engagement member comprises a pin fixed to the rod; and the second engagement member comprises an elongated groove provided in the piston, the pin being movably engaged in the elongated groove. The plate member is preferably an annular plate disposed about the rod and between the pin and the pumping member-moving spring. The pumping member-moving spring and the piston-following spring are preferably disposed one within the other and about the rod.

In the preferred form of the invention, the fuel pump body has defined therein the pump chamber, an intake chamber and a discharge chamber; the pump chamber is bounded by the pumping member; the intake chamber is connected to the pump chamber via a first one-way valve; and the discharge chamber is connected to the pump chamber via a second one-way valve. The first one-way valve allows flow in a direction from the intake chamber to the pump chamber; and the second one-way valve allows flow in a direction from the pump chamber to the discharge chamber.

BRIEF DESCRIPTION OF THE DRAWINGS

FIG. 6 is a cross section of a prior art fuel pump.

FIG. 7 is a cross section of essential parts of the fuel pump of FIG. 6.

DETAILED DESCRIPTION OF THE INVENTION

The present application is based on Jaspanese Application 2000-401707 filed Dec. 28, 2000.

The invention will be described with reference to the accompanying drawings.

Figure 1:
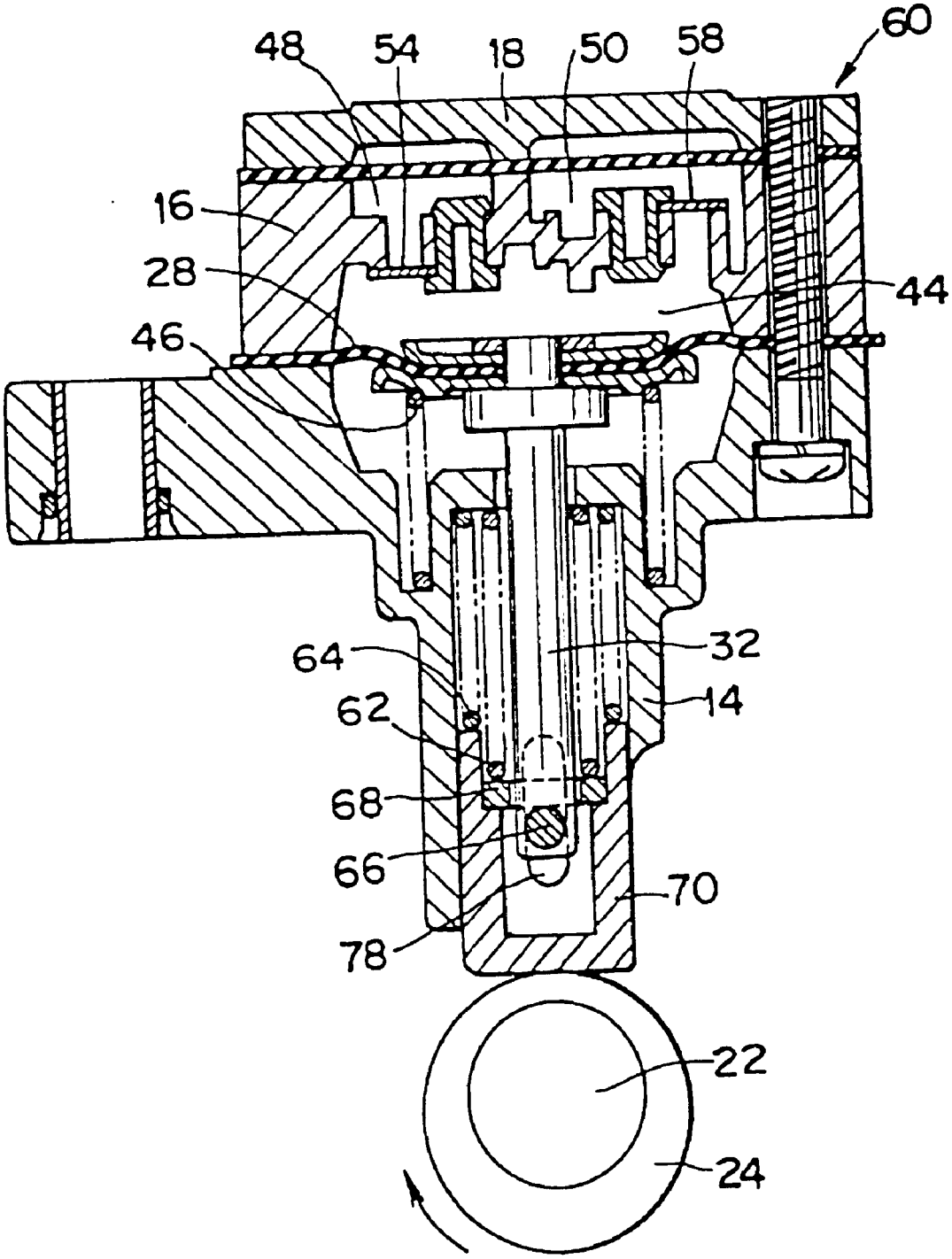
FIG. 1 is a cross section of a fuel pump according to one embodiment of the invention.
Figure 2:
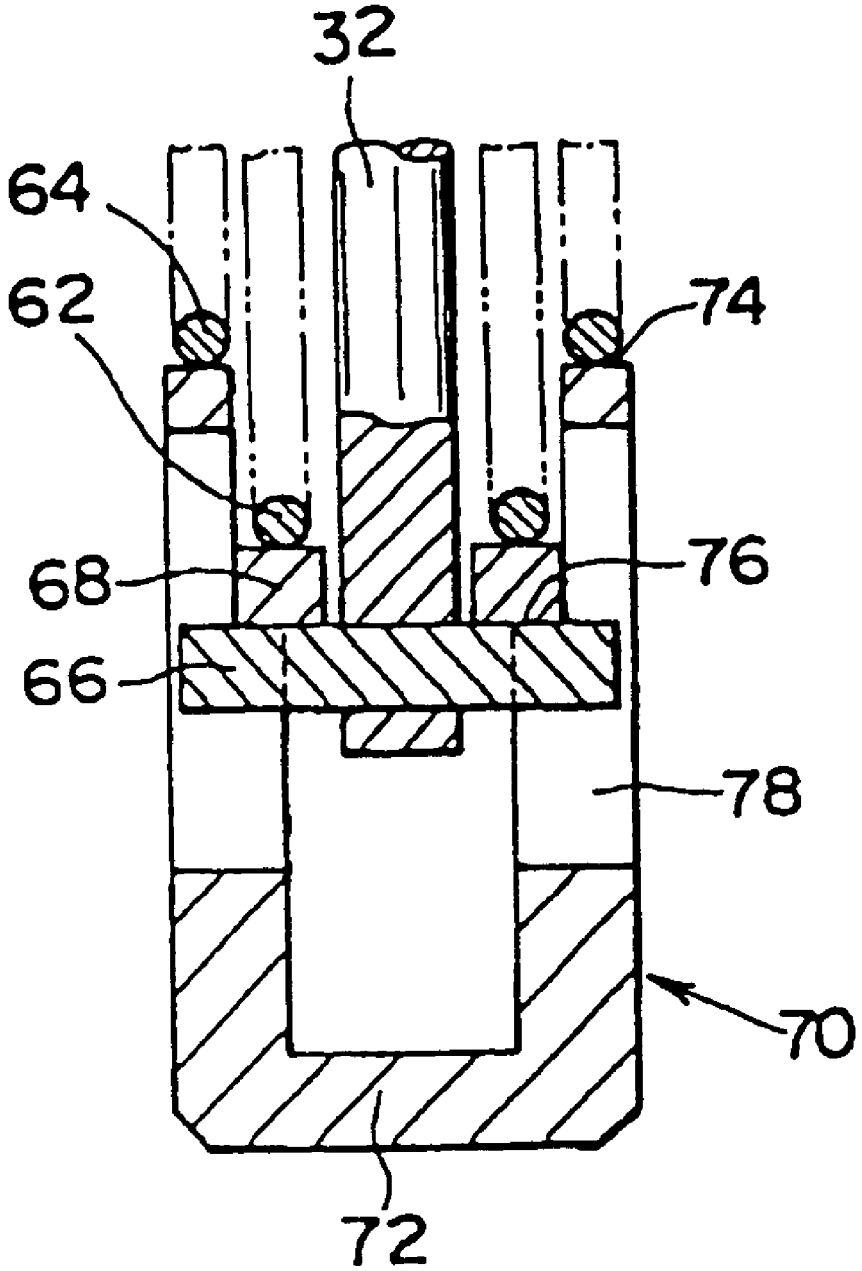
FIG. 2 is a cross section of essential parts of the fuel pump shown in FIG.1.

FIG. 1 is a cross section of a fuel pump 60 according to a preferred embodiment of the invention. FIG. 2 is a cross section of essential parts of the fuel pump 60. In these drawings, parts corresponding to those in FIG. 6 are denoted by corresponding reference numerals. The fuel pump 60 uses a diaphragm-lowering (or pump member-moving) spring 62 and a piston following-spring 64 in place of the piston spring 26 used in the pump shown in FIG. 6. Similarly to the fuel pump 10 of FIG. 6, the fuel pump 60 includes a fuel pump body comprising a bottom body part 14 and a top body part 16, a pumping member such as the illustrated diaphragm 28, a rod 32, a pump chamber 44, an intake chamber 48 and a discharge chamber 50, and is to be arranged adjacent an eccentric cam 24 secured to a rotary shaft 22. The fuel pump 60 includes a cylindrical piston 70 reciprocally mounted to the fuel pump body for movement between an extended position and a retracted position at opposite ends of a piston stroke. The present discussion assumes that the fuel pump is oriented so that the top body part 16, the bottom body part 14, the piston 70 and the eccentric cam 24 are arranged top down in this order as shown in FIG. 1. However, the fuel pump can be oriented in any direction, and further, these components may be assembled in other suitable arrangements.

The diaphragm-lowering spring 62 is provided around the rod 32 and is coaxial with the rod 32. Further, the piston-following spring 64 is provided around the diaphragm-lowering spring 62. A pin 66 as a first engagement member is fixedly attached to a tip of the rod 32, and an annular plate 68 is attached around the rod 32 in order to come into contact with the pin 66. The diaphragm-lowering spring 62 has one end thereof kept in contact with the bottom body part 14 and the other end thereof kept in contact with the annular plate 68. The diaphragm-lowering spring 62 normally maintains the annular plate 68 in contact with the pin 66.

In the fuel pump 60, the cylindrical piston 70 has a closed end 72, which is arranged to be in contact with the eccentric cam 24, and an annular open end 74 which is contacted by one end of the piston-following spring 64. The piston-following spring 64 has the other end thereof kept in contact with the bottom body part 14, so that the piston 70 is continuously urged toward the eccentric cam 24.

The piston 70 has an annular step 76 projecting radially inwardly with respect to the open end 74. The annular plate 68 is sized so as to contact against the annular step 76, such that the annular plate 68 is kept from moving toward the closed end 72 of the piston 70 beyond the annular step 76. Further, the piston 70 has a groove 78 elongated in the moving direction of the piston 70, and the groove 78 serves as a second engagement member. The pin 66 fixedly attached to the rod 32. is fitted in the groove 78. Engagement of the pin 66 with the groove 78 limits the range of movement of the pin 66 (and thus the rod 32 and diaphragm 28) relative to the piston 70.

According to this embodiment, the fuel pump 60 includes both the diaphragm-lowering spring 62 and the piston-following spring 64. The piston-following spring 64 urges the piston 70 downward (toward the eccentric cam 24) while the diaphragm-lowering spring 62 urges the diaphragm 28 downward (toward the eccentric cam 24) via the annular plate 68, pin 66 and rod 32. A diaphragm (or pumping member) spring 46 urges the diaphragm 28 upward.

The operation of the fuel pump will be described hereinafter. Referring to FIG. 1, when the piston 70 is moved furthest toward the eccentric cam 24 (i.e. to its most extended position), the diaphragm 28 is in a lowered state. In this state, the diaphragm-lowering spring 62 urges the annular plate 68 into contact with the pin 66 and the annular step 76, such that pin 66 is positioned slightly below the lengthwise center of the groove 78.

Figure 3:
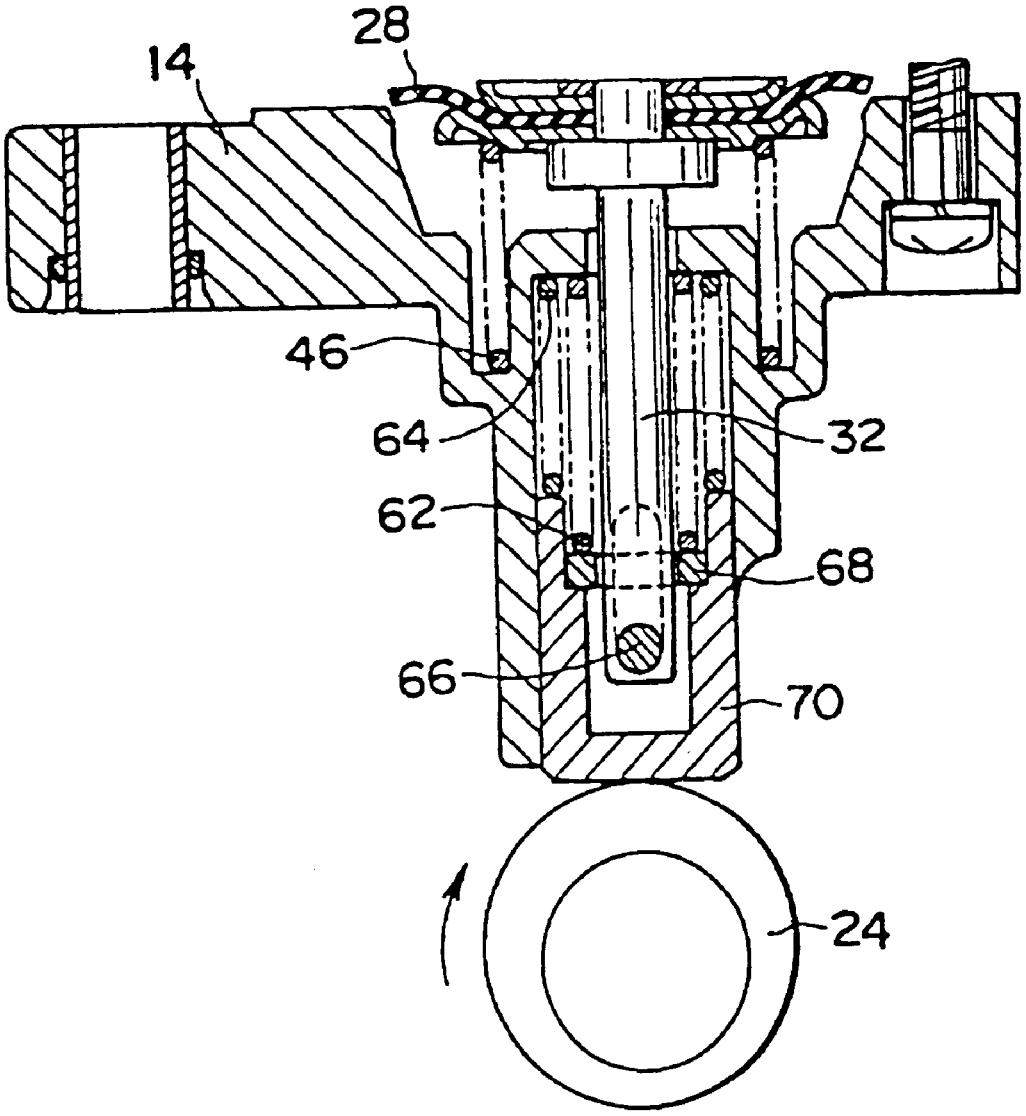
FIG. 3 is a cross section of a portion of the fuel pump of FIG. 1 showing a piston in a raised state.

As the eccentric cam 24 starts rotating from the state shown in FIG. 1, the piston 70 is raised (see FIG. 3), and the piston-following spring 64 and the diaphragm-lowering spring 62 are compressed. In this state, the annular plate 68 in contact with the annular step 76 is also raised together with the piston 70 while both the rod 32 and the diaphragm 28 are not raised, so that the annular plate 68 moves away from the pin 66. The pin 66 comes close to the bottom of the groove 78 in response to the upward movement of the piston 70. With the diaphragm-lowering spring compressed due to the upward movement of the piston 70, the diaphragm spring 46 is freed to expand and move the diaphragm, as well as the rod 32, upward. Since discharge of the fuel from the pump chamber 44 to a discharge chamber 50 requires the fuel to flow through a discharge path 56 via a discharge valve (e.g. a one-way valve) 58, there is a discharge resistance, and this discharge resistance causes the diaphragm 28 to initially remain at a lowered (extended)-position as shown in FIG. 1 when the piston 70 is raised to a certain level.

Figure 4:
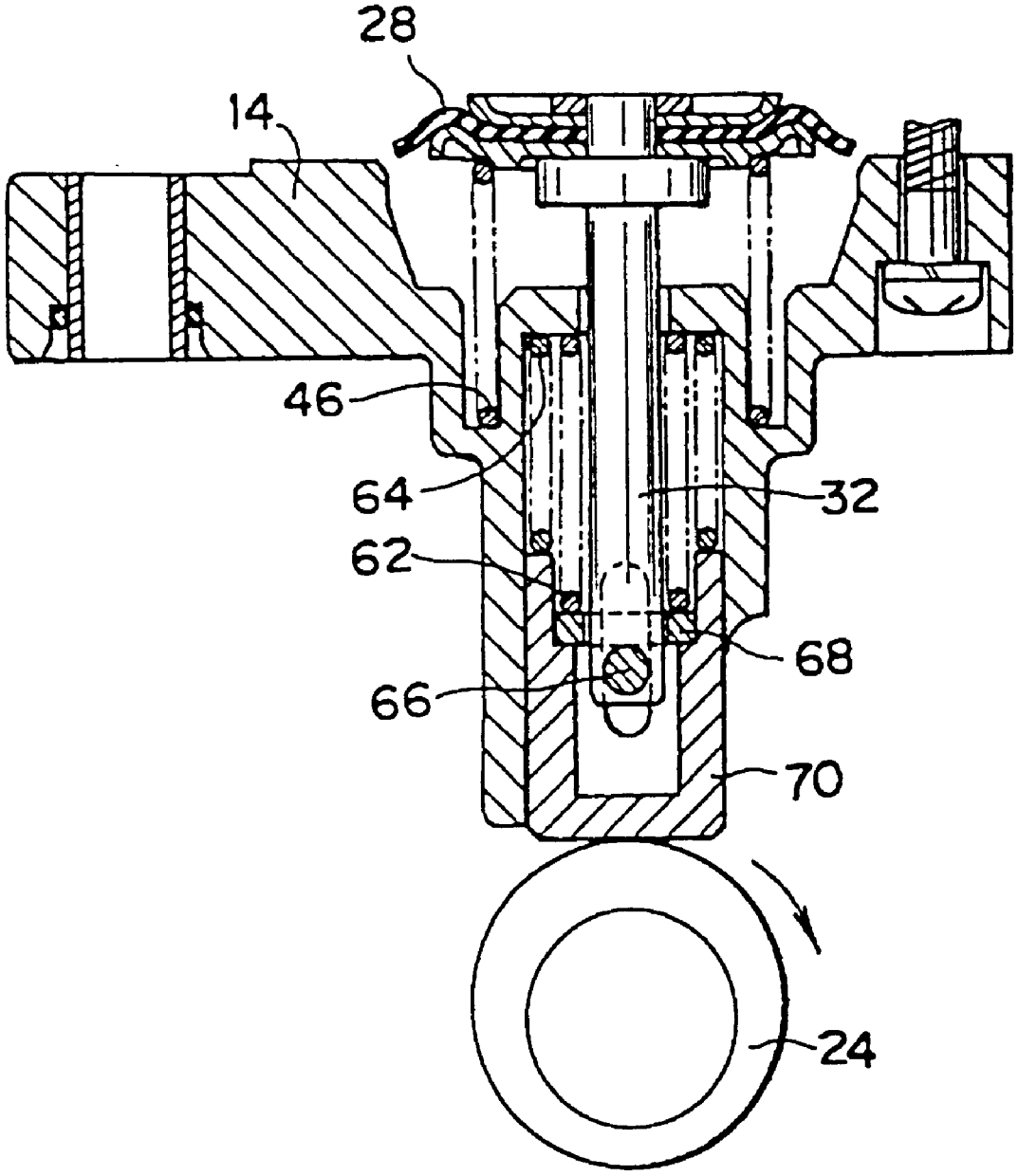
FIG. 4 is similar to FIG. 3, but further showing a diaphragm in a raised state.

When the piston 70 is raised to near the top of its piston stroke, the compressed diaphragm spring 46 begins to expand, and raises the diaphragm 28 (see FIG. 4). The pin 66 fixedly attached to the rod 32 comes into contact with the annular plate 68 as the diaphragm 28 and the rod 32 are raised.

Figure 5:
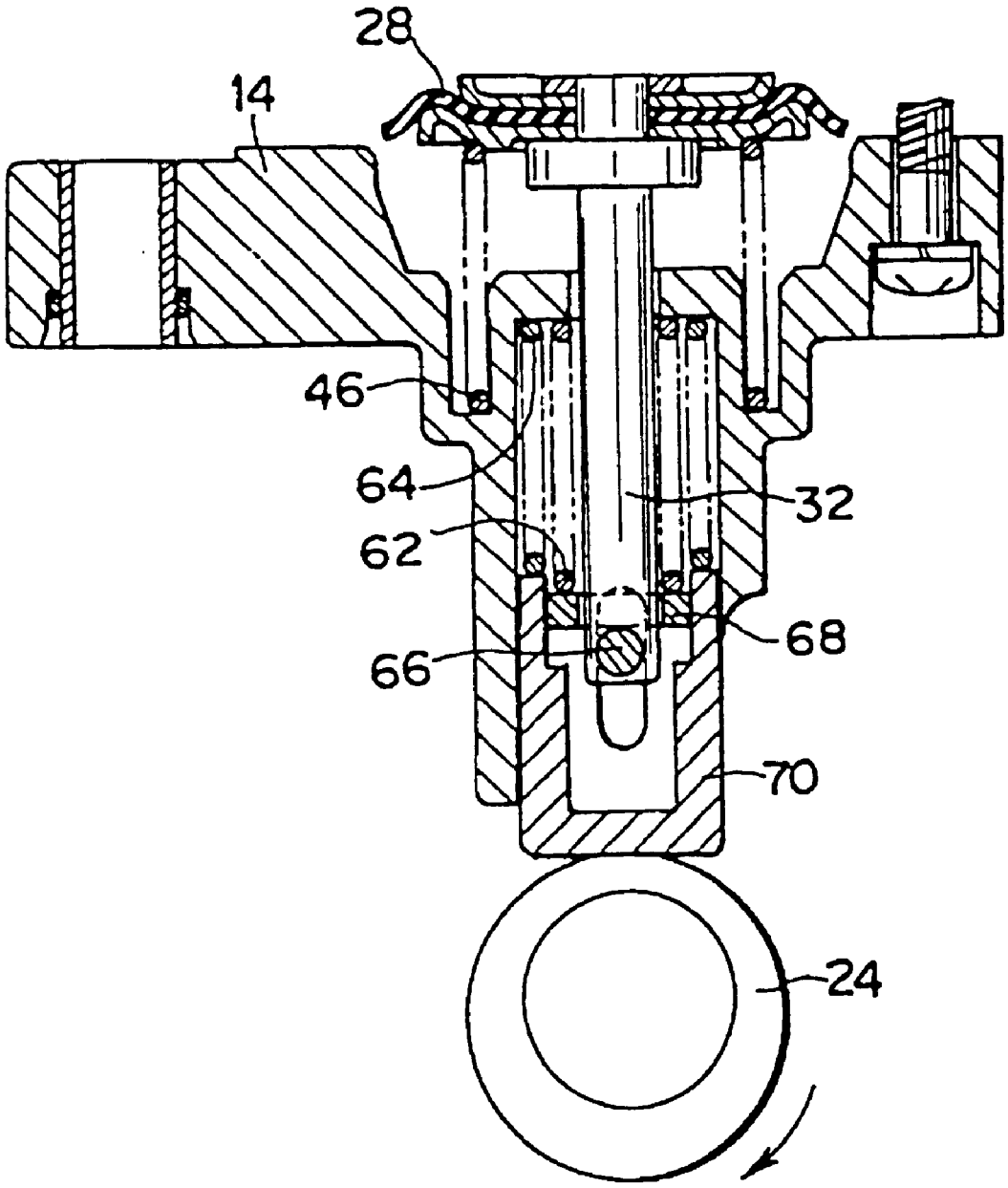
FIG. 5 is similar to FIG. 3, but showing the piston in a lowered state.

As the eccentric cam 24 continues rotating from the state shown in FIG. 4, the piston-following spring 64 moves the piston 70 downward. At the beginning of the downward movement of the piston 70, the diaphragm 28 initially remains at a raised position (shown in FIG. 5) clue to upward urging by the diaphragm spring 46 and an intake resistance of the fuel due to the intake of fuel from an intake chamber 48 to the pump chamber 44 requiring the fuel to flow through an intake path 52 via an intake valve (e.g. a one-way valve) 54. In other words, both the rod 32 and the pin 66 initially remain at raised positions, so that the annular plate 68 is kept spaced above the annular step 76 by the pin 66.

Thereafter, when the piston 70 moves down to its lowest (extended) position, the diaphragm-lowering spring 62 lowers the diaphragm 28 via the annular plate 68, and the pin 66 and the rod 32 against the resilient force of the diaphragm spring 46 and the intake resistance of the fuel. Therefore, the fuel pump 60 returns to the state shown in FIG. 1, thus completing one cycle of the fuel pump 60.

According to the invention, the piston 70 is moved downward by the piston-following spring 64, and the diaphragm 28 is moved downward by the diaphragm-lowering spring 62. In short, the piston 70 and the diaphragm 28 are lowered using separate springs. This enables the piston-following spring 64 and the diaphragm-lowering spring 62 to have relatively mild resiliencies compared with the piston spring 26 used in the fuel pump 10 shown in FIG. 6.

Further, the diaphragm-lowering spring 62 is not in direct contact with the pin 66 but is in contact with the pin 66 via the annular plate 68, so that force of the diaphragm-lowering spring 62 can be uniformly applied to the pin 66.

Since the present invention uses the two springs to lower the piston and the diaphragm instead of the one spring used in the prior art shown in FIG. 6, the forces required for lowering the piston and the diaphragm are provided by the two springs, thereby allowing the springs to be made of relatively inexpensive material, and reducing the cost of the springs.

Further, since the downward movement of the piston and that of the pumping member (e.g. diaphragm) are independent according to the present invention, the piston can reliably follow the eccentric cam thereby preventing undesirable noises which may otherwise be caused by the piston following the eccentric cam in an inferior manner.

Still further, the diaphragm is lowered in a delayed manner after the piston starts moving downward, thereby improving the durability of the diaphragm, the pin and other components. In addition, with the arrangement of the present invention the fuel is introduced at a moderate speed, and this is effective to increase a discharge amount of the fuel.

Although preferred embodiments of the present invention are described in detail above, the present invention contemplates that many modifications and alternative structures can be utilized. Therefore, the above description is to be taken as exemplary and not in a limiting sense, such that the invention is defined by the metes and bounds of the appended claims.

What is claimed is:

1. A fuel pump for pumping fuel in response to rotation of an eccentric cam, said fuel pump comprising:

a fuel pump body having a pump chamber;

a pumping member movably provided at said pump chamber for pressurizing and depressurizing said pump chamber, said pumping member being movable between a first pumping member position and a second pumping member position;

a piston movably mounted to said fuel pump body and being arranged to be operably engaged with the eccentric cam for movement between first and second ends of a piston stroke, said piston being operably coupled to said pumping member so that said pumping member is caused to move toward said first pumping member position due to said piston moving toward said first end of said piston stroke, and toward said second pumping member position due to said piston moving toward said second end of said piston stroke;

a piston following spring operably engaged with said piston to urge said piston toward said first end of the piston stroke;

a pumping member-moving spring operably engaged with said pumping member to independently urge said pumping member toward said first pumping member position; and wherein said piston-following spring and said pumping member-moving spring are disposed in parallel with each other.

2. A fuel pump according to claim 1, wherein said pumping member comprises a diaphragm.

3. A fuel pump according to claim 1, wherein said fuel pump body comprises a first fuel pump body part, and a second fuel pump body part secured to said first fuel pump body part; and said pumping member comprises a diaphragm sandwiched between said first and second fuel pump body parts.

4. A fuel pump according to claim 1, wherein said fuel pump body has defined therein said pump chamber, an intake chamber and a discharge chamber;

said pump chamber is bounded by said pumping member;

said intake chamber is connected to said pump chamber via a first one-way valve; and said discharge chamber is connected to said pump chamber via a second one-way valve.

5. A fuel pump according to claim 4, wherein said first one-way valve allows flow in a direction from said intake chamber to said pump chamber; and said second one-way valve allows flow in a direction from said pump chamber to said discharge chamber.

6. A fuel pump for pumping fuel in response to rotation of an eccentric cam, said fuel pump comprising:

a fuel pump body having a pump chamber;

a pumping member movably provided at said pump chamber for pressurizing and depressurizing said pump chamber, said pumping member being movable between a first pumping member position and a second pumping member position;

a piston movably mounted to said fuel pump body and being arranged to be operably engaged with the eccentric cam for movement between first and second ends of a piston stroke, said piston being operably coupled to said pumping member so that said pumping member is caused to move toward said first pumping member position due to said piston moving toward said first end of said piston stroke, and toward said second pumping member position due to said piston moving toward said second end of said piston stroke;

a piston-following spring operably engaged with said piston to urge said piston toward said first end of the piston stroke;

a pumping member-moving spring operably engaged with said pumping member to urge said pumping member toward said first pumping member position; and a pumping member spring mechanism urging said pumping member toward said second pumping member position.

7. A fuel pump for pumping fuel in response to rotation of an eccentric cam, said fuel pump comprising:

a fuel pump body having a pump chamber;

a pumping member movably provided at said pump chamber for pressurizing and depressurizing said pump chamber, said pumping member being movable between a first pumping member position and a second pumping member position;

a piston movably mounted to said fuel pump body and being arranged to be operably engaged with the eccentric cam for movement between first and second ends of a piston stroke, said piston being operably coupled to said pumping member so that said pumping member is caused to move toward said first pumping member position due to said piston moving toward said first end of said piston stroke and toward said second pumping member position due to said piston moving toward said second end of said piston stroke;

a piston-following spring operably engaged with said piston to urge said piston toward said first end of the piston stroke;

a pumping member-moving spring operably engaged with said pumping member to urge said pumping member toward said first pumping member position;

a first engagement member coupled to said pumping member;

a second engagement member provided at said piston and being arranged for engagement with said first engagement member; and a plate member positioned between said first engagement member and said pumping member-moving spring so as to be urged by said pumping member-moving spring toward said first engagement member.

8. A fuel pump for pumping fuel in response to rotation of an eccentric cam, said fuel pump comprising:

a fuel pump body having a pump chamber;

a pumping member movably provided at said pump chamber for pressurizing and depressurizing said pump chamber said pumping member being movable between a first pumping member position and a second pumping member position;

a piston movably mounted to said fuel pump body and being arranged to be operably engaged with the eccentric cam for movement between first and-second ends of a piston stroke, said piston being operably coupled to said pumping member so that said pumping member is caused to move toward said first pumping member position due to said piston moving toward said first end of said piston stroke, and toward said second pumping member position due to said piston moving toward said second end of said piston stroke;

a piston-following spring operably engaged with said piston to urge said piston toward said first end of the piston stroke;

a pumping member-moving spring operably engaged with said pumping member to independently urge said pumping member toward said first pumping member position;

a first engagement member coupled to said pumping member so as to be movable therewith; and wherein said pumping member-moving spring is operably engaged with said first engagement member and urges said first engagement member to move in a direction to cause said pumping member to move toward said first pumping member position.

9. A fuel pump according to claims 8, further comprising a second engagement member engageable with said first engagement member to limit an amount of movement of said first engagement member relative to said piston.

10. A fuel pump according to claim 9, further comprising a rod coupling said first engagement member to said pumping member;

wherein said first engagement member comprises a pin fixed to said rod; and wherein said second engagement member comprises an elongated groove provided in said piston, said pin being movably engaged in said elongated groove.

11. A fuel pump according to claim 10, further comprising an annular plate disposed about said rod and between said pin and said pumping member-moving spring.

12. A fuel pump according to claim 11, wherein said pumping member-moving spring and said piston-following spring are disposed one within the other and about said rod.

13. A fuel pump for pumping fuel in response to rotation of an eccentric cam, said fuel pump comprising:

a fuel pump body having a pump chamber;

a diaphragm secured to said fuel pump body and movable between a pump chamber pressurizing position and a pump chamber depressurizing position;

a piston reciprocally mounted to said fuel pump body for movement between an extended position and a retracted position, said piston being arranged to be operably engaged with the eccentric cam so as to be movable upon operation thereof, and said piston being operably coupled to said diaphragm so that at least some movements of said piston cause movements of said diaphragm;

a spring arrangement including a piston-following spring urging said piston toward said extended position, and a diaphragm-moving spring independently said diaphragm toward said pump chamber depressurizing position, said piston-following spring and said diaphragm-moving spring being disposed in parallel with each other.

14. A fuel pump according to claim 13, wherein said fuel pump body has defined therein said pump chamber, an intake chamber and a discharge chamber;

said pump chamber is bounded by said diaphragm;

said intake chamber is connected to said pump chamber via a first one-way valve; and said discharge chamber is connected to said pump chamber via a second one-way valve.

15. A fuel pump according to claim 14, wherein said first one-way valve allows flow in a direction from said intake chamber to said pump chamber; and said second one-way valve allows flow in a direction from said pump chamber to said discharge chamber.

16. A fuel pump for pumping fuel in response to rotation of an eccentric cam, said fuel pump comprising:

a fuel pump body having a pump chamber;

a diaphragm secured to said fuel pump body and movable between a pump chamber pressurizing position and a pump chamber depressurizing position;

a piston reciprocally mounted to said fuel pump body for movement between an extended position and a retracted position, said piston being arranged to be operably engaged with the eccentric cam so as to be movable upon operation thereof, and said piston being operably coupled to said diaphragm so that at least some movements of said piston cause movements of said diaphragm;

a spring arrangement including a piston-following spring urging said piston toward said extended position, and a diaphragm-moving spring urging said diaphragm toward said pump chamber depressurizing position;

a first engagement member coupled to said diaphragm;

a second engagement member provided at said piston and being arranged to engage with said first engagement member; and a plate member positioned between said first engagement member and said diaphragm-moving spring, said plate member being movable with respect to said first engagement member.

17. A fuel pump according to claim 16, further comprising a rod coupled to said diaphragm and fixed to said first engagement member; and wherein said plate member comprises an annular plate member disposed about said rod.

18. A fuel pump according to claim 17, wherein said diaphragm-moving spring and said piston-following spring are disposed one within the other and about said rod.

19. A fuel pump for pumping fuel in response to rotation of an eccentric cam, said fuel pump comprising:

a fuel pump body having a pump chamber;

a diaphragm secured to said fuel pump body and movable between a pump chamber pressurizing position and a pump chamber depressurizing position;

a piston reciprocally mounted to said fuel pump body for movement between an extended position and a retracted position, said piston being arranged to be operably engaged with the eccentric cam so as to be movable upon operation thereof, and said piston being operably coupled to said diaphragm so that at least some movements of said piston cause movements of said diaphragm;

a spring arrangement including a piston-following spring urging said piston toward said extended position, and a diaphragm-moving spring independently urging said diaphragm toward said pump chamber depressurizing position;

said first engagement member comprises a pin; and said second engagement member comprises an elongated groove formed in said piston, said pin being movably engaged in said elongated groove.

20. A fuel pump for pumping fuel in response to rotation of an eccentric cam, said fuel pump comprising:

a fuel pump body having a pump chamber;

a diaphragm secured to said fuel pump body and movable between a pump chamber pressurizing position add a pump chamber depressurizing position;

a piston reciprocally mounted to said fuel pump body for movement between an extended position and a retracted position, said piston being arranged to be operably engaged with the eccentric cam so as to be movable upon operation thereof, and said piston being operably coupled to said diaphragm so that at least some movements of said piston cause movements of said diaphragm; and a spring arrangement including a piston-following spring urging said piston toward said extended position, a diaphragm-moving spring urging said diaphragm toward said pump chamber depressurizing position, and a diaphragm spring urging said diaphragm toward said pump chamber pressurizing position.

21. A fuel pump for pumping fuel in response to rotation of an eccentric cam, said fuel pump comprising:

a fuel pump body having a pump chamber;

a diaphragm secured to said fuel pump body and movable between a pump chamber pressurizing position and a pump chamber depressurizing position;

a piston reciprocally mounted to said fuel pump body for movement between an extended position and a retracted position, said piston being arranged to be operably engaged with the eccentric cam so as to be movable upon operation thereof, and said piston being operably coupled to said diaphragm so that at least some movements of said piston cause movements of said diaphragm;

a spring arrangement including a piston-following spring urging said piston toward said extended position, and a diaphragm-moving spring independently urging said diaphragm toward said pump chamber depressurizing position, both said piston-following spring and said diaphragm-moving spring being disposed on a side of said diaphragm opposite said pump chamber.

22. A fuel pump according to claim 21, wherein said diaphragm-moving spring and said piston-following spring are disposed one within the other.

23. A fuel pump for pumping fuel in response to rotation of an eccentric cam, said fuel pump comprising:

a fuel pump body having a pump chamber;

a pumping member movably provided at said pump chamber for pressurizing and depressurizing said pump chamber, said pumping member being movable between a first pumping member position and a second pumping member position;

a piston movably mounted to said fuel pump body and being arranged to be operably engaged with the eccentric cam for movement between first and second ends of a piston stroke, said piston being operably coupled to said pumping member so that said pumping member is caused to move toward said first pumping member position due to said piston moving toward said first end of said piston stroke, and toward said second pumping member position due to said piston moving toward said second end of said piston stroke;

a piston-following spring operably engaged with said piston to urge said piston toward said first end of the piston stroke;

a pumping member-moving spring operably engaged with said pumping member to independently urge said pumping member toward said first pumping member position; and wherein both said piston-following spring and said pumping member-moving spring are disposed on a side of said pumping member opposite said pump chamber.

* * * * *